US011779791B2

(12) United States Patent
Hunter

(10) Patent No.: US 11,779,791 B2
(45) Date of Patent: Oct. 10, 2023

(54) EXERCISE BANDS AND METHODS OF MANUFACTURING SAME

(71) Applicant: Andrew Hunter, Brooklyn, NY (US)

(72) Inventor: Andrew Hunter, Brooklyn, NY (US)

( * ) Notice: Subject to any disclaimer, the term of this patent is extended or adjusted under 35 U.S.C. 154(b) by 164 days.

(21) Appl. No.: 17/509,168

(22) Filed: Oct. 25, 2021

(65) Prior Publication Data

US 2022/0126156 A1 Apr. 28, 2022

Related U.S. Application Data

(60) Provisional application No. 63/105,465, filed on Oct. 26, 2020.

(51) Int. Cl.

| | |
|---|---|
| ***A63B 21/055*** | (2006.01) |
| ***A63B 21/00*** | (2006.01) |
| ***A63B 21/16*** | (2006.01) |
| ***A63B 21/04*** | (2006.01) |

(52) U.S. Cl.

CPC .... *A63B 21/0555* (2013.01); *A63B 21/00043* (2013.01); *A63B 21/0557* (2013.01); *A63B 21/16* (2013.01); *A63B 21/4035* (2015.10); *A63B 21/04* (2013.01)

(58) Field of Classification Search

CPC ..... A63B 21/0555; A63B 21/00043; A63B 21/16; A63B 21/4035; A63B 21/04; A63B 2225/09; A63B 21/4003; A63B 21/4013; A63B 21/4015; A63B 21/4007; A63B 21/0004; A63B 21/0552; A63B 21/0557; A63B 2208/0204; A63B 2208/0219; A63B 2208/0247; A63B 21/0442; A63B 21/00069; A63B 21/00061

See application file for complete search history.

(56) References Cited

U.S. PATENT DOCUMENTS

| | | | | |
|---|---|---|---|---|
| 3,769,939 | A | 11/1973 | Wais et al. | |
| 4,121,827 | A * | 10/1978 | Weider | A63B 21/00185 482/125 |
| D368,501 | S * | 4/1996 | Woodruff | D21/672 |
| 5,813,954 | A * | 9/1998 | Wilkinson | A63B 21/4003 482/125 |
| 7,137,935 | B2 | 11/2006 | Clarke et al. | |
| 7,727,131 | B2 | 6/2010 | Longo | |
| 8,657,727 | B1 | 2/2014 | Kassel et al. | |
| 9,630,081 | B2 * | 4/2017 | Gillespie | A63B 23/1245 |
| 10,307,632 | B1 * | 6/2019 | Santana | A63B 21/4035 |
| 10,610,722 | B2 | 4/2020 | Roberts | |
| D933,144 | S * | 10/2021 | Kushner | D21/692 |
| 2010/0216613 | A1 * | 8/2010 | Pacini | A63B 21/0552 482/122 |
| 2011/0028287 | A1 | 2/2011 | Kassel | |
| 2011/0092347 | A1 | 4/2011 | Kassel | |
| 2015/0005141 | A1 | 1/2015 | Krahling et al. | |

* cited by examiner

*Primary Examiner* — Andrew S Lo
*Assistant Examiner* — Andrew M Kobylarz
(74) *Attorney, Agent, or Firm* — SLEMAN & LUND LLP

(57) ABSTRACT

In some examples, an exercise band comprising includes a main stretchable tubing defining a first lumen, a main safety cord disposed within the first lumen of the stretchable tubing, a Y-shaped cord coupled to the main safety cord at one end within the first lumen of the main stretchable tubing, at least one lasso tubing defining a second lumen, and at least one lasso safety cord disposed within the at least one lasso tubing, the at least one lasso safety cord being coupled to two ends of the Y-shaped cord within the second lumen.

18 Claims, 4 Drawing Sheets

EXERCISE BANDS AND METHODS OF MANUFACTURING SAME

CROSS-REFERENCE TO RELATED APPLICATIONS

The present disclosure claims priority to U.S. provisional application, Ser. No. 63/105,465 filed Oct. 26, 2020, the contents of which are hereby incorporated by reference in its entirety as if fully set forth herein.

FIELD OF THE DISCLOSURE

The present disclosure relates to devices and methods for exercising. More specifically, the present invention relates to exercise bands for resistance training.

BACKGROUND OF THE DISCLOSURE

Exercise machines are typically large and require the user to go to a designated gym or room to train. Additionally, exercise equipment can be expensive, and users may require several different machines, each machine being limited to training a given muscle. Resistance bands may be used to perform exercises but they too require a host of add-ons (e.g., anchors, handles, terminal fixtures) to properly function. Thus, it would be beneficial to make an affordable, mobile training device that has robust capability and can be used to perform different exercises without the need for add-ons.

SUMMARY OF THE DISCLOSURE

In some examples, an exercise band includes a main stretchable tubing defining a first lumen, a main safety cord disposed within the first lumen of the stretchable tubing, a Y-shaped cord coupled to the main safety cord at one end within the first lumen of the main stretchable tubing, at least one lasso tubing defining a second lumen, and at least one lasso safety cord disposed within the at least one lasso tubing, the at least one lasso safety cord being coupled to two ends of the Y-shaped cord within the second lumen.

BRIEF DESCRIPTION OF THE DISCLOSURE

Figure 1A:
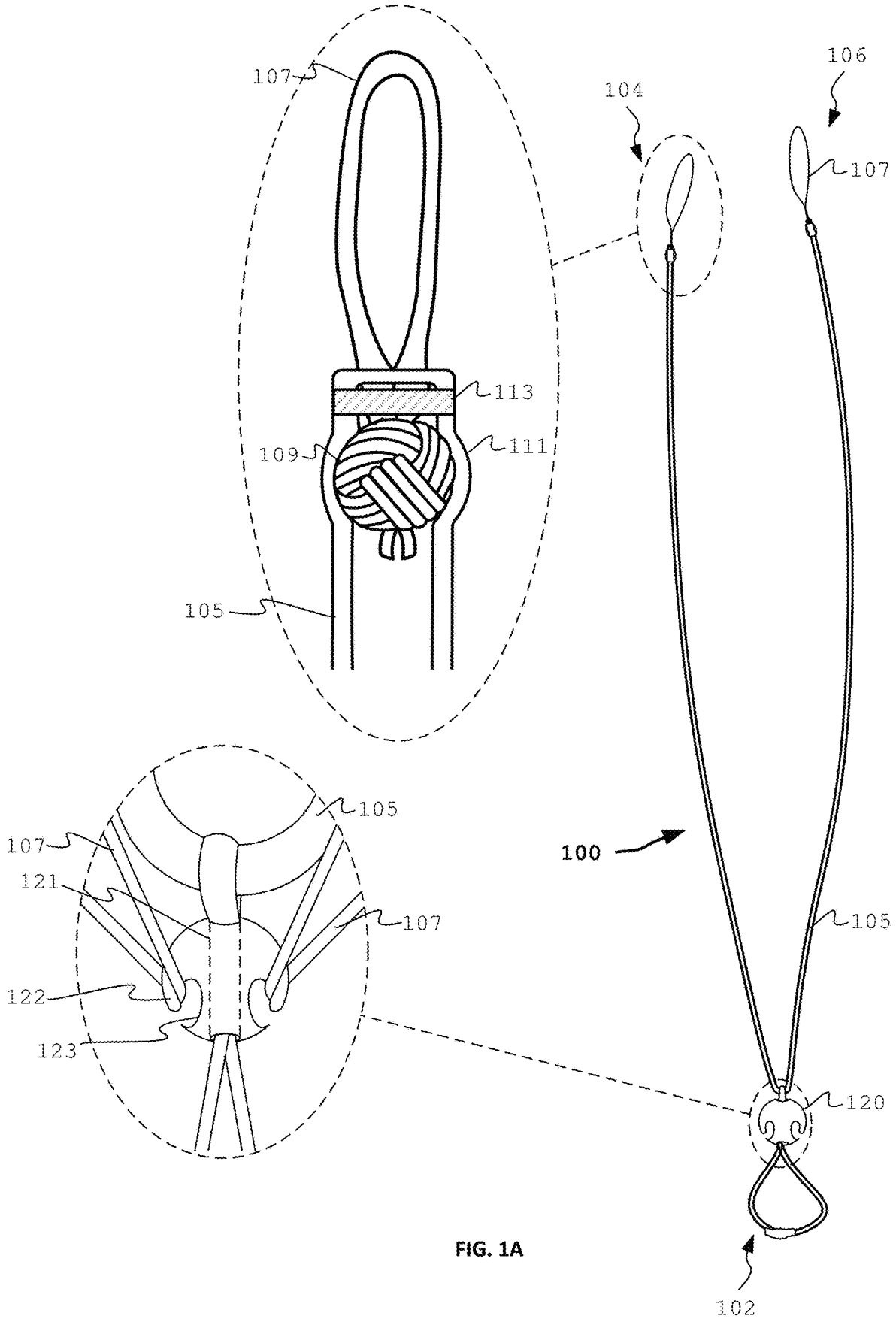
Figure 1B:
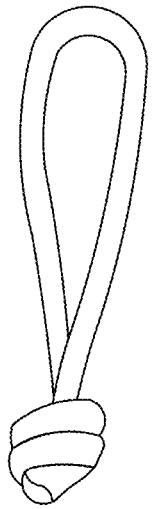
Figure 1C:
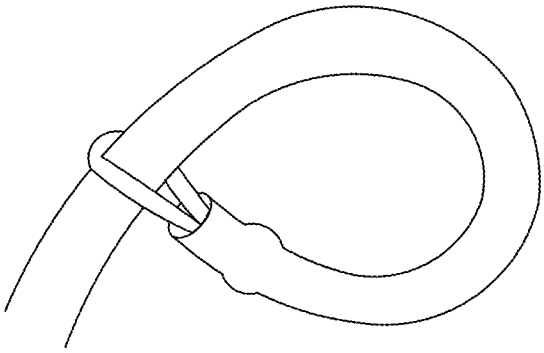
Figure 2:
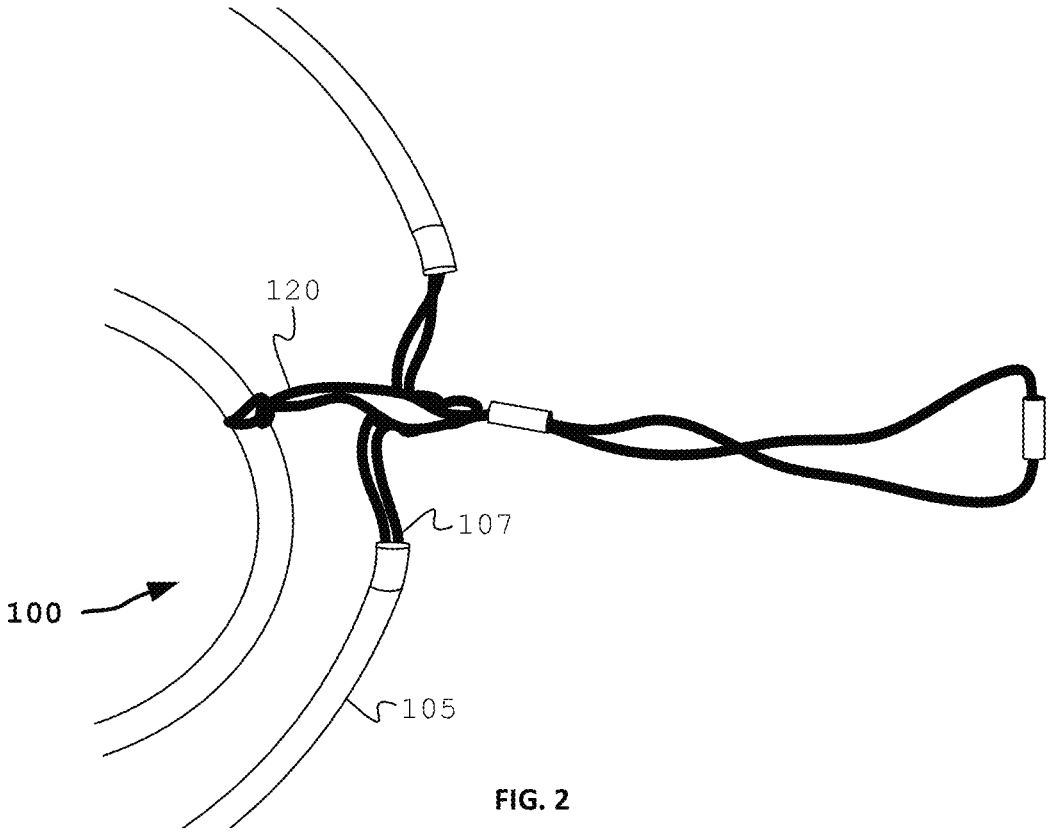
Figure 3:
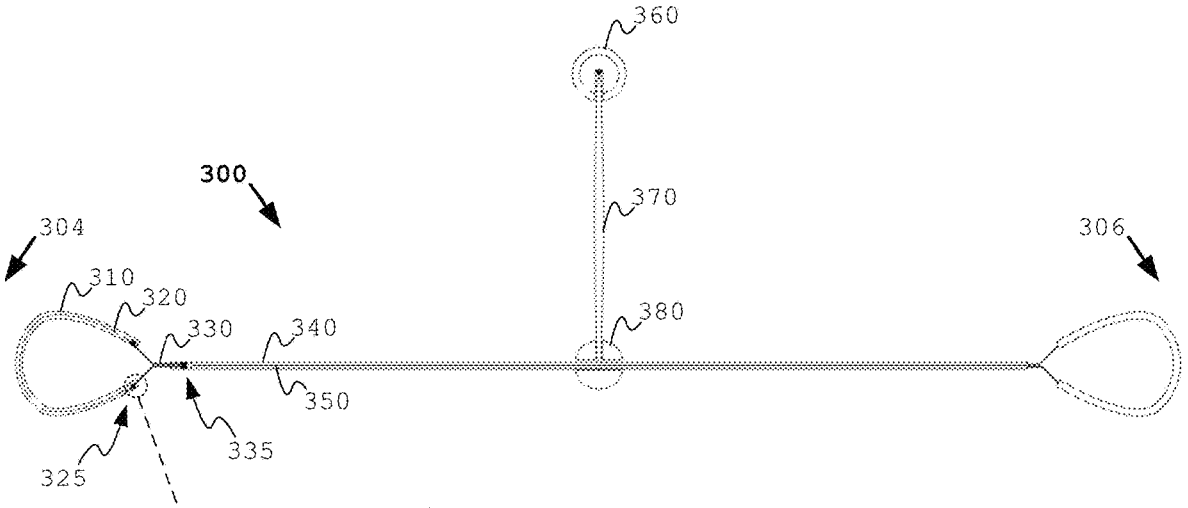
Figure 4:
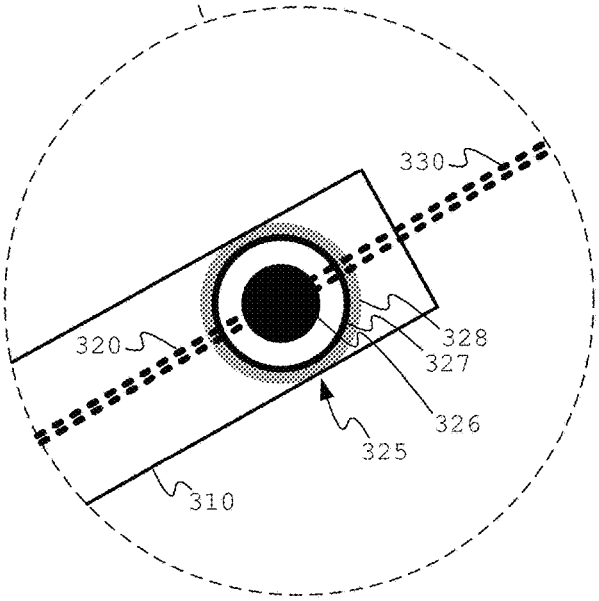
Figure 4:
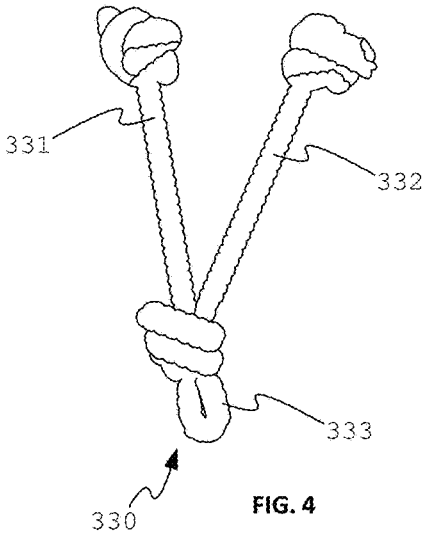

Various embodiments of the presently disclosed exercise bands are disclosed herein with reference to the drawings, wherein:

FIGS. 1A-C are a schematic front view of an exercise band according to one embodiment, and schematic of a loop and one possible way of attaching it to a band;

FIG. 2 is a schematic front view of another embodiment of an exercise band having an anchor; and FIGS. 3-4 show a schematic front view of another embodiment of an exercise band, and a photograph of a Y-shaped nylon cord.

Various embodiments of the present invention will now be described with reference to the appended drawings. It is to be appreciated that these drawings depict only some embodiments of the disclosure and are therefore not to be considered limiting of its scope.

DETAILED DESCRIPTION

Despite the various improvements that have been made to exercise equipment, conventional devices and methods suffer from certain shortcomings such as those discussed above. There therefore is a need for further improvements to the devices and methods used for exercising. Among other advantages, the present disclosure may address one or more of these needs.

FIG. 1 illustrates an exercise band 100 that can be used a as a stand-alone piece of exercise equipment for strength training and conditioning. Band 100 generally extends between a first end 104 and a second end 106, and includes an anchoring section 102 approximately halfway between the first and second ends. Exercise band 100 may include a hollow stretchable tubing 105 (e.g., latex tubing and suitable other high elastomer rated rubber tubing). Tubing 105 may be between 2 feet and 20 feet. In one example, tubing 105 may be 16 feet in length between ends, and may have an outside diameter of between 7/16" and 1" to provide resistance against body movements.

Each of ends 104, 106 may terminate in a loop 107. Each loop 107 may include, for example, a 14-inch loop of 1/8 to 3/16 inch paracord or nylon cord secured to each end of the tubing 105. Loops 107 may be manipulated with the attached tubing for a number of versatile applications in different exercise movements without any additional components, including the creation of handles, an attachment limbs and the body, as well as the aforementioned interface with the anchor to increase resistance during exercises. As shown in the detailed view of FIG. 1A, loop 107 is formed of a cord that is at least partially disposed inside of the tubing 105 (see also FIG. 1B). The cord of loop 107 may be formed into a knot 109 and pliers or similar materials may be used to radially stretch the interior of the tubing so that the knot can be compressed and inserted into the interior of tubing 105. As shown, the knot 109 forms a bulge in the tubing, which creates a tight elastic fit that prevents the loop 107 from being pulled apart from the tubing. Optionally, a custom wire clamp 113 or other attachment may be coupled to the outside of tubing 105 distal to the bulging portion 111 for additional safety to secure the loop to the tubing 105. Alternatively, or additionally, the ends of tubing 105 may undergo a vulcanization process, before or after insertion of the knot of the loop, to harden the rubber to reduce its elasticity so that the tube become incapable of stretching to effectively lock the loop 107 within tubing 105. As shown in FIG. 10, a portion of the band may be passed through the loop 107 to perform certain exercises.

Additionally, as shown in FIG. 1A, an anchor 120 may be disposed adjacent anchoring section 102. In at least some examples, anchor 120 may include a cord and rubber plug that allows the resistance band to be attached to a fixed anchor point (FIG. 2). Anchor 120 may allow the user to double the band 100 over itself to create more resistance as required by the exercise to be performed. In at least some examples, anchor may be in the form of a plastic or polymer-based generally circular fixation device having an internal through bore 121 from one end to the other, and pair of notches or cutouts 123 having fingers 122 for retaining portions of the band and/or nylon cord as necessary. Notches 123 may allow the user to double, triple or quadruple the band over itself to perform different exercises.

FIG. 3 illustrates another embodiment of an exercise band 300 that can be used a as a stand-alone piece of exercise equipment for strength training and conditioning. Band 300 generally extends between a first end 304 and a second end 306, the two ends terminating in handles or lassos. An anchoring section is attached to the band 300 midway between the two handles. The components of the band will be described from left to right as shown in FIG. 3. It will be appreciated that certain components are shown in one of the handles and not the other by way of illustration, but that both handles may be formed having the same components and using the same techniques and construction. Beginning at first end 304, band 300 includes a hollow lasso tubing 310 and a lasso safety cord 320 disposed within and extending through the interior of lasso tubing 310. In at least some examples, lasso tubing 310 is approximately 16" in length and lasso safety cord is approximately 32" in length. When disposed within lasso tubing 310, lasso safety cord 320 may be compressed within the interior lumen of the tubing as it is longer. The mismatch of lengths allows the lasso safety cord 320 to be long enough when the lasso tubing 310 is stretched during exercise. In at least some examples, lasso tubing 310 is stretchable and safety cord 320 is not.

In some examples, lasso tubing 310 includes a hollow stretchable material (e.g., latex tubing and suitable other high elastomer rated rubber tubing). Lasso tubing 310 may have an outside diameter of between 7/16" and 1". In some examples, lasso safety cord 320 may have a three-thread woven construction that allows it to be compressed and completely disposed within the interior of the lasso tubing.

A Y-shaped nylon cord 330 may be coupled to lasso safety cord 320 at both ends of the safety cord. Specifically, a Y-shaped nylon cord 330 as shown in the photograph of FIG. 4, may be folded and knotted to create 2 upper prongs 331, 332, and a lower prong 333, the two upper prongs being attachable to the ends of lasso safety cord 320, and the lower prong 333 being attachable to the main safety cord at joints 325, 335. Y-shaped nylon cord 330 may be approximate 13' in length.

Turning back to the detailed view of FIG. 3, an enlarged view of joint 325 is shown. In this example, lasso safety cord 310 is tied together with one prong of the Y-shaped nylon cord 330 at knot 326. Knot 326 is optionally disposed inside a 14 mm wooden ball 327, which acts to provide more friction and reduce the sliding of the knot within the joint structure. A bonding agent 328 may be used on the inside and/or outside of the wooden ball 327. In some examples, bonding agent 328 includes a urethane adhesive such as, LOCTITE® U-05FL, and the bonding agent 328 may additionally couple the joint 325 to the interior of lasso tubing 310 so that the joint is immovable within tubing 310. A similar joint may be created on the other side of the safety cord with a second prong of Y-shaped nylon cord 330.

The elongated main body of band 300 may be formed of a main tubing 340 that includes a main safety cord 350 extending therethrough. Main tubing 340 may be formed of a same material as lasso tubing 310. In some examples, main tubing 340 is approximately 16' in length, and main safety cord 350 is approximately 48' in length, the main safety cord 350 being compressed inside the hollow interior of the main tubing 340.

At joint 335, main safety cord 350 is coupled to the lower prong 333 of the Y-shaped nylon cord 330 using a method similar to that described above. Specifically, the two components may be tied together or knotted, placed in a wooden ball and a bonding agent may couple the components together and to the interior of main tubing 340. As shown, all three joints are disposed inside their respective tubings.

Prior to assembling the second handle at end 306, the central anchoring portion of the device may be assembled. In this example, the central portion of the device may optionally include an anchor ball 360 coupled to a nylon anchoring cord 370 and a base connector 380. Anchor ball 360 may include a 1" hard silicone. In some examples, the outer shell of ball 360 (e.g., approximately the outer half of the ball) may include a softer or more deformable portion to eliminate or reduce safety concerns. A bore 361 may be formed into ball 360 from the outside to the center so that nylon anchoring cord 370 can be inserted therethrough and joined (via a bonding agent or other suitable technique) to the interior of ball 360. Nylon anchoring cord 370 may include a 42" length that is tied into a loop and threaded through a T-shaped passageway in base connector 380. In at least some examples, the T-shaped passageway of connector 380 receives a portion, or a doubled over portion, of nylon anchoring cord 370 through a first slit of the passageway, and main tubing 340 and main safety cord 350 through a second slit of the passageway, the first slit and the second slit being perpendicular. As shown, nylon anchoring cord 370 may be wrapped around main tubing 340 and main safety cord 350 inside connector 380. In this example, base connector 380 includes a second a first slit that extends through half the connector, and a second slit that extends from one end of the connector to the other.

With the assembly of connector 380 complete, the second handle may be constructed in a similar manner, the second handle having a Y-shaped nylon cord 330 coupled to lasso safety cord 320 and lasso tubing 310 as previously described.

It will be understood that a tubing may be selected from a range of tubings, each having a different elasticity and resistance to the user to accommodate a user's strength and/or weight. Additionally, different configurations of removable or replaceable anchors are contemplated.

In use, a user may use the anchor to affix the device to a wall or other fixation point and pull the band to stretch it to perform certain exercises such as wrestling takedowns, judo throws, kicks, punches, and standard calisthenic movements such as squats, lunges, butterflies, back bends, and crunches. The loops may also be attached to the anchor to perform different exercise or adjust the length of the band.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

What is claimed is:

1. An exercise band comprising:

a main stretchable tubing defining a first lumen;

a main safety cord disposed within the first lumen of the main stretchable tubing;

a Y-shaped cord coupled to the main safety cord at one end within the first lumen of the main stretchable tubing;

at least one lasso tubing defining a second lumen; and at least one lasso safety cord disposed within the at least one lasso tubing, the at least one lasso safety cord being coupled to two prongs of the Y-shaped cord within the second lumen.

2. The exercise band of claim 1, wherein the main stretchable tubing comprises latex.

3. The exercise band of claim 1, wherein the main stretchable tubing is between 10 and 20 feet in length.

4. The exercise band of claim 3, wherein the main stretchable tubing is 16 feet in length.

5. The exercise band of claim 1, wherein the main safety cord is 48 feet in length.

6. The exercise band of claim 1, wherein the at least one lasso tubing comprises two lasso tubings disposed at opposing ends of the main safety cord.

7. The exercise band of claim 1, wherein the at least one lasso safety cord comprises two lasso safety cords.

8. The exercise band of claim 1, wherein the Y-shaped cord is coupled at its ends via joints.

9. The exercise band of claim 8, wherein each of the joints comprises a knotting of the Y-shaped cord to at least one of the main safety cord, and the at least one lasso safety cord.

10. The exercise band of claim 9, wherein each knotting is disposed inside a wooden ball.

11. The exercise band of claim 9, further comprising a bonding agent configured to couple the joint to a portion of the at least one lasso tubing and the main stretchable tubing.

12. The exercise band of claim 1, further comprising a silicone anchor ball having at least one bore extending from an outside diameter to a center of the anchor ball.

13. The exercise band of claim 1, further comprising an anchoring cord coupled to a silicone anchor ball and the main stretchable tubing.

14. The exercise band of claim 13, further comprising a base connector having a T-shaped bore.

15. The exercise band of claim 14, wherein the T-shaped bore comprises a first slit and a second slit, the first slit and the second slit being disposed perpendicular to one another, a portion of the main stretchable tubing extending through the second slit, and a portion of the anchoring cord extending through the first slit.

16. The exercise band of claim 15, wherein the anchoring cord is wrapped around the main stretchable tubing within the base connector.

17. An exercise band comprising:

a main stretchable tubing defining a first lumen;

a main safety cord disposed within the first lumen of the stretchable tubing;

a Y-shaped cord coupled to the main safety cord at one end within the first lumen of the main stretchable tubing;

at least one lasso tubing defining a second lumen; and at least one lasso safety cord disposed within the at least one lasso tubing, the at least one lasso safety cord being coupled to two prongs of the Y-shaped cord within the second lumen;

an anchoring cord; and a base connector having a T-shaped bore, the T-shaped bore comprising a first slit and a second slit, the first slit and the second slit being disposed perpendicular to one another, a portion of the main stretchable tubing extending through the second slit, and a portion of the anchoring cord extending through the first slit.

18. The exercise band of claim 17, further comprising an anchor ball coupled to the anchoring cord.

* * * * *